US008918938B2

(12) United States Patent
Osiol

(10) Patent No.: US 8,918,938 B2
(45) Date of Patent: Dec. 30, 2014

(54) PERSONALIZED FOOTWEAR

(76) Inventor: Scott Osiol, Pottstown, PA (US)

( * ) Notice: Subject to any disclaimer, the term of this patent is extended or adjusted under 35 U.S.C. 154(b) by 693 days.

(21) Appl. No.: 13/136,241

(22) Filed: Jul. 27, 2011

(65) Prior Publication Data

US 2013/0025162 A1 Jan. 31, 2013

(51) Int. Cl.

| | |
|---|---|
| ***A43D 8/16*** | (2006.01) |
| ***A43B 3/12*** | (2006.01) |
| ***A43B 3/00*** | (2006.01) |
| ***A43B 3/24*** | (2006.01) |
| ***A43B 3/10*** | (2006.01) |

(52) U.S. Cl.

CPC ..... *A43B 3/0078* (2013.01); *A43B 3/246* (2013.01); *A43B 3/108* (2013.01); *A43D 8/16* (2013.01); *A43D 2200/60* (2013.01)

USPC ..... 12/146 B; 36/136; 36/11.5

(58) Field of Classification Search

CPC ..... A43D 8/16; A43D 8/02; A43D 8/10; A43D 2200/60; A43B 3/0078; A43B 3/246; A43B 3/108

USPC ..... 12/146 B, 77; 36/136, 11.5, 132, 112

See application file for complete search history.

(56) References Cited

U.S. PATENT DOCUMENTS

| | | | | |
|---|---|---|---|---|
| 1,958,203 | A * | 5/1934 | Pfau | 409/182 |
| D167,533 | S * | 8/1952 | Pastine | D2/917 |
| 5,054,148 | A * | 10/1991 | Grumbine | 12/142 N |
| 6,006,412 | A * | 12/1999 | Bergmann et al. | 29/407.04 |
| D437,988 | S * | 2/2001 | Senif | D2/952 |
| 6,588,086 | B2 | 7/2003 | Trybus | |
| 6,775,585 | B2 | 8/2004 | Bedont, Jr. et al. | |
| 7,073,244 | B2 | 7/2006 | Olari et al. | |
| D568,032 | S * | 5/2008 | Lavergne | D2/917 |
| 7,854,071 | B2 | 12/2010 | Goonetilleke et al. | |
| 7,945,343 | B2 | 5/2011 | Jones et al. | |
| 2002/0166258 | A1 * | 11/2002 | Posa | 36/11.5 |
| 2004/0094864 | A1 | 5/2004 | Franzene | |
| 2006/0101559 | A1 | 5/2006 | Moore, III et al. | |
| 2007/0137067 | A1 | 6/2007 | Fallon et al. | |
| 2007/0186404 | A1 | 8/2007 | Drew et al. | |
| 2008/0010867 | A1 | 1/2008 | Davis, III | |
| 2010/0083533 | A1 | 4/2010 | Terner et al. | |
| 2010/0083536 | A1 | 4/2010 | Barrow | |
| 2010/0193385 | A1 | 8/2010 | Sackett et al. | |
| 2011/0083341 | A1 | 4/2011 | Baum | |

* cited by examiner

*Primary Examiner* — Ted Kavanaugh

(74) *Attorney, Agent, or Firm* — Muskin & Farmer LLC; Jon Muskin; Shawn Farmer

(57) ABSTRACT

Customized or personalized recessed designs can be cut into the bottom of the soles of flip flops, sandals, boots, and any other flat soled footwear using computerized numerical control machining. The customized recessed design can be created in reverse (i.e., in mirror image) to leave a specified design or message when the shoe is pressed into material capable or taking an impression such as sand or snow. Designs can also be created to appear forward (non-mirrored) on the sole so that that design or text is legible when looking at the sole of the shoe. The footwear can be custom produced at the request of a customer, who can specify the nature of the customization for one or more pairs of footwear. Each of a pair of the footwear may have a different design, message or message portion.

15 Claims, 8 Drawing Sheets

19.

10.
4.
7.
3.
1.
2.
21.
22.
18.
13.
12.

PERSONALIZED FOOTWEAR

BACKGROUND

Footwear typically comprises an upper and a sole. The sole is the interface between the foot and the ground. Some soles have a multi-part construction that includes an outsole and a midsole. The sole generally provides traction, support and/or protection for the foot from the ground. Flip-flops or thongs refer to an open style of footwear in which a flat sole is held on the foot by a Y-shaped strap or thong that passes between the first (big) and second toes and around either side of the foot. Flip-flops can also be held to the foot with a single strap over the front of the foot rather than with a thong.

Typically, the sole of the shoe and any design included in the sole is manufactured before the shoe is assembled using steel cutting dies and die-cutting machinery that create the tread design of the sole. Sole designs can also be created through injection molding, with the assembly taking place after the production of the sole. With these methods the bottommost layer of foam or rubber has the design die cut or molded into it. Once the bottom layer has been molded, or die cut and the die cut material removed, the footwear is assembled, and the bottommost layer of the sole is adhered to the rest of the footwear.

Because of the cost of producing the steel cutting die or producing a mold for injection molding, these two production methods are cost-effective for creating large numbers of the same style of tread pattern but are typically not cost effective for generating a small number of shoes.

SUMMARY

Customized or personalized recessed designs can be cut into the bottom of the soles of flip flops, sandals, boots, and any other flat soled footwear using computerized numerical control machining. The customized recessed design can be created in reverse (i.e., in mirror image) to leave a specified design or message impressed into material capable of taking an impression when the shoe is pressed into the material. For example, a wearer of the shoes who walks or otherwise travels by foot in sand, soft soil, snow or unhardened concrete can leave such an impression. Designs can also be created to appear forward (non-mirrored) on the sole so that the design or text is legible when looking at the sole of the shoe.

The footwear can be custom produced at the request of a customer, who can specify the nature of the customization for one or more pairs of footwear. Each shoe of a pair of the footwear may have a different design, message or message portion cut into it. Automated routing using a CNC table and CNC machine can be utilized to cut the customized recessed design into the bottom of the sole. Routing bits including but not limited to an end mill routing bit can be used to machine the material that makes up the bottom soles of the footwear. Suitable materials for the bottom sole can include rubber, plastic, or foam or any material that can be cut by the CNC machine.

The footwear can be held level and firmly in place through the use of a series of two or more stacked boards or plates. One or more of the boards can include a negative cavity shaped to the contours of the footwear. The negative space can be cut so as to prevent the shoe from moving once it has been placed into the negative space. That is, the footwear can fit snugly into a negative space in an interior board cut to fit the outline of the footwear sole. The top and bottom boards in the stack of boards can include similar negative spaces cut out in the shape of the footwear sole. The cut outs of the top and bottom boards can be slightly smaller so as to hold the footwear firmly in place while leaving the bottom sole exposed for machining Alternatively, the top and bottom boards can expose only a portion of the bottom sole. The bottom of the sole can be inserted facing upward.

Alternatively, instead of using a series of three or more plates, a single bottom plate that includes the negative cavity created by the combination of the interior and bottom plates can be created. The footwear strapping or other upper can be allowed to hang down through a cavity in the bottom plate to avoid interference with the cutting operation. The stackable plates can include aligned holes near the four corners of each board to allow the stack of boards to be bolted to the CNC table during the cutting operation. Once bolted in place the CNC machine can be programmed to cut a design into the sole of the footwear to the desired depth. Each shoe of a pair of footwear can be cut separately with a different design.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DETAILED DESCRIPTION

Overview

Computerized Numerical Control (CNC) refers to machine tools automated by commands encoded on a storage medium, instead of being manually controlled using hand wheels or levers, or mechanically automated using only cams. The first NC machines were built in the 1940s and 1950s and were based on existing tools modified with motors that moved the controls to follow points fed into the system on punched tape. These early servomechanisms were augmented with analog and digital computers to develop modern computer numerical control (CNC) machine tools.

In modern CNC systems, component design can be integrated with computer-aided design (CAD) and computer-aided manufacturing (CAM) programs. The device can be programmed to use a number of different tools-drills, saws, and so on. Alternatively a number of different machines can be used with an external controller and human or robotic operators that move the component from machine to machine. Regardless, a series of steps needed to produce a part can produce a part that closely matches the original CAD design in a highly automated fashion.

In accordance with aspects of the subject matter disclosed herein through the use of CNC technology and suitably programmed CNC tools, pairs of sandals, flip flops, boots and other flat soled footwear with custom cut sole designs, can cost effectively be created in small quantities. In contrast to producing footwear by the injection molding or the steel die cutting method, the footwear described herein can be fully assembled before machining. The footwear produced using CNC technology can cost effectively be made in quantities as low as one pair or even one shoe.

In order for a CNC machine to effectively operate on the sole of a pair of footwear, the footwear can be held firmly in place, with the sole side facing up as a flat level plane to prevent the footwear from moving during the cutting operation, and to make the cuts at a consistent depth throughout the entirety of the design.

Personalized Footwear

In the following detailed description, certain specific terminology will be employed for the sake of clarity and particular embodiments will be described in accordance with the requirements of 35 USC 112, but it is to be understood that the same is not intended to be limiting and should not be so construed inasmuch as the subject matter described herein is capable of taking many forms and variations within the scope of the appended claims.

Figure 1:
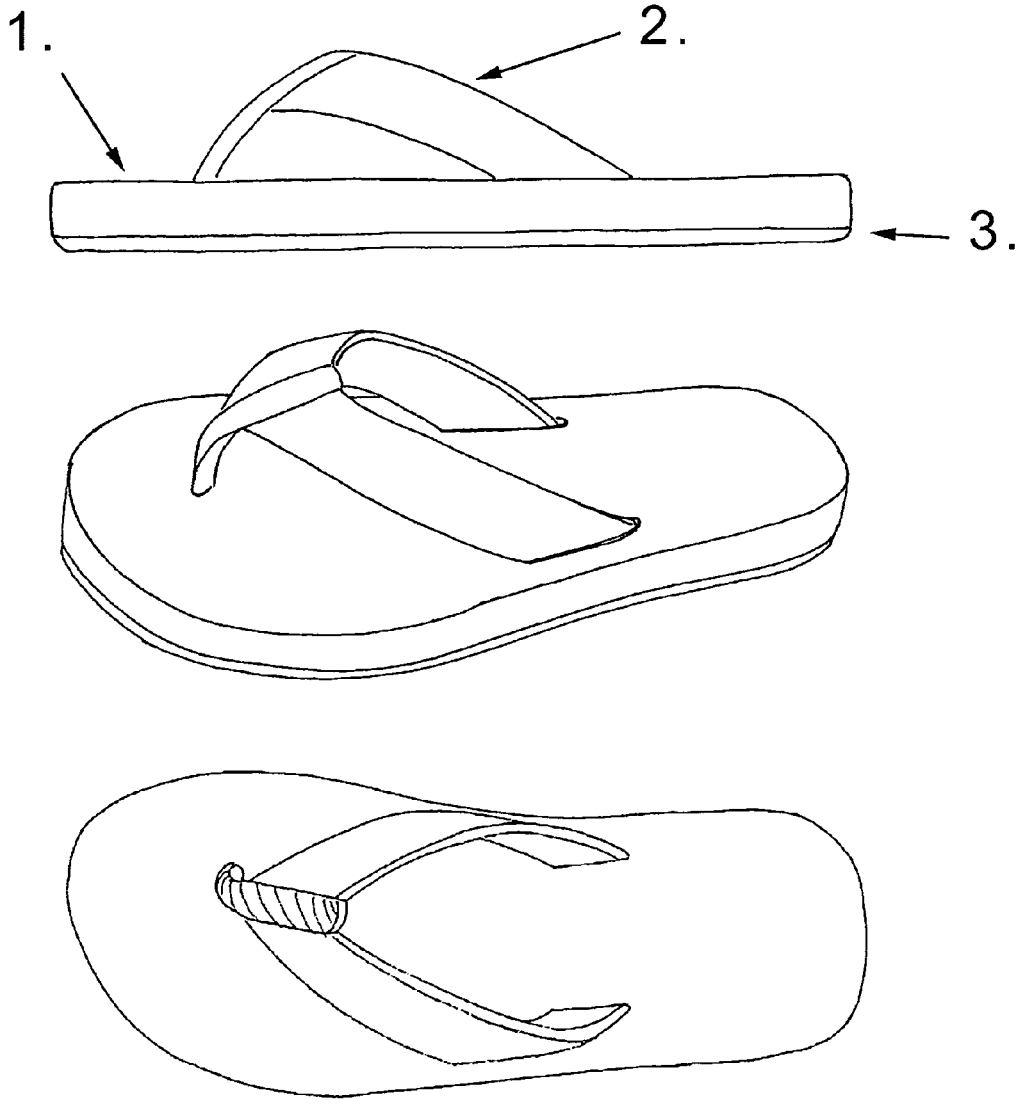
FIG. 1 illustrates an example of footwear in accordance with aspects of the subject matter disclosed herein.

Referring to the drawings, FIG. 1 depicts three different perspective views of an example of a type of footwear that can be machined using the techniques described herein. It will be appreciated by those of skill in the art that other types of footwear including any type of footwear having a bottom sole that can be flattened when fitted into the plates or any type of footwear with a flat bottomed sole can be suitable for machining as described herein. The footwear can be fully or partially manufactured or assembled footwear or can be unassembled footwear. FIG. 1 illustrates a flip flop 1 with a thong style strap 2, having a bottom sole 3. The bottom sole 3 can be made of plastic, foam plastic, rubber and/or any material that can be machined as described herein. The flat bottom sole 3 presents a flat, even, and machineable surface when properly mounted and prepared for the CNC machine 11 to cut. It will be appreciated that non flip flop footwear such as boots, etc. or any footwear with flat bottom soles can be similarly machined.

Figure 2:
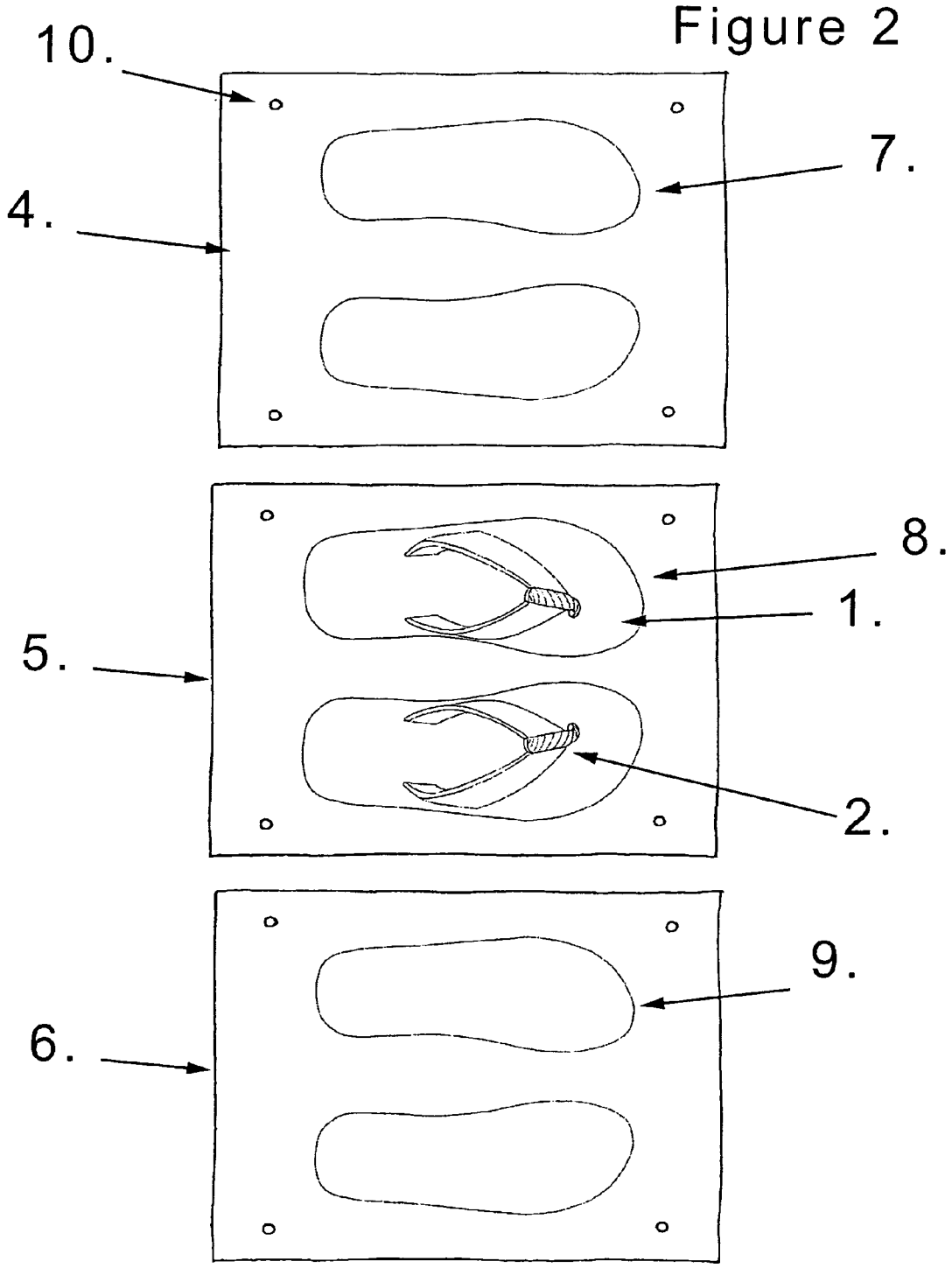
FIG. 2 illustrates an example of a top perspective of three plates and the footwear as it would fit into the middle plate in accordance with aspects of the subject matter disclosed herein.
Figure 4:
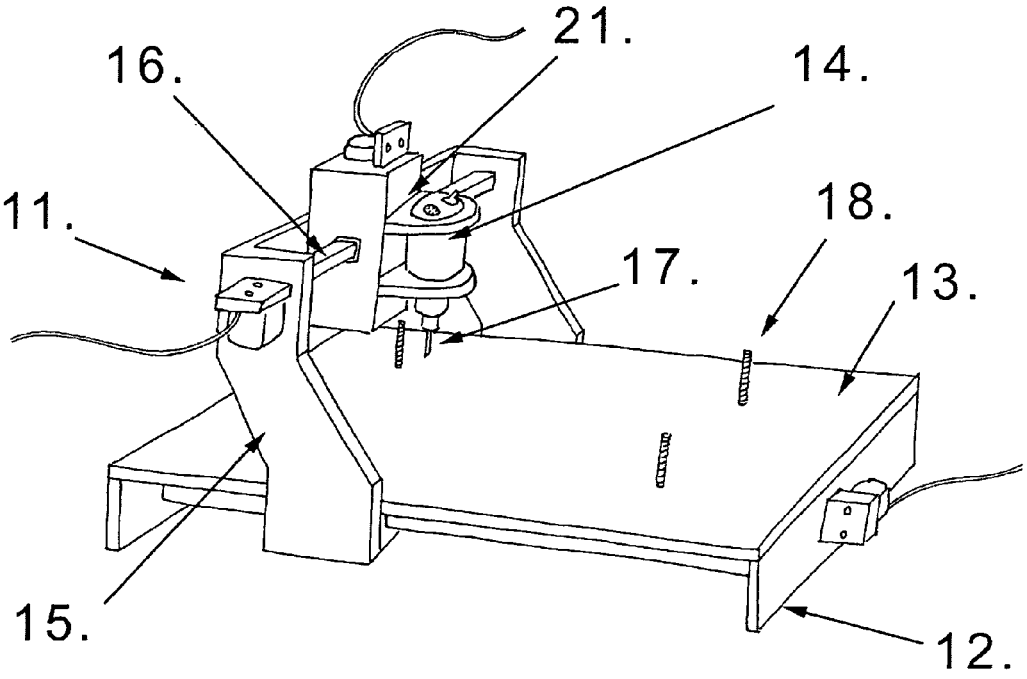
FIG. 4 illustrates a perspective view of an example of a CNC router table, and four bolts, without plates and footwear affixed in accordance with aspects of the subject matter disclosed herein.
Figure 7:
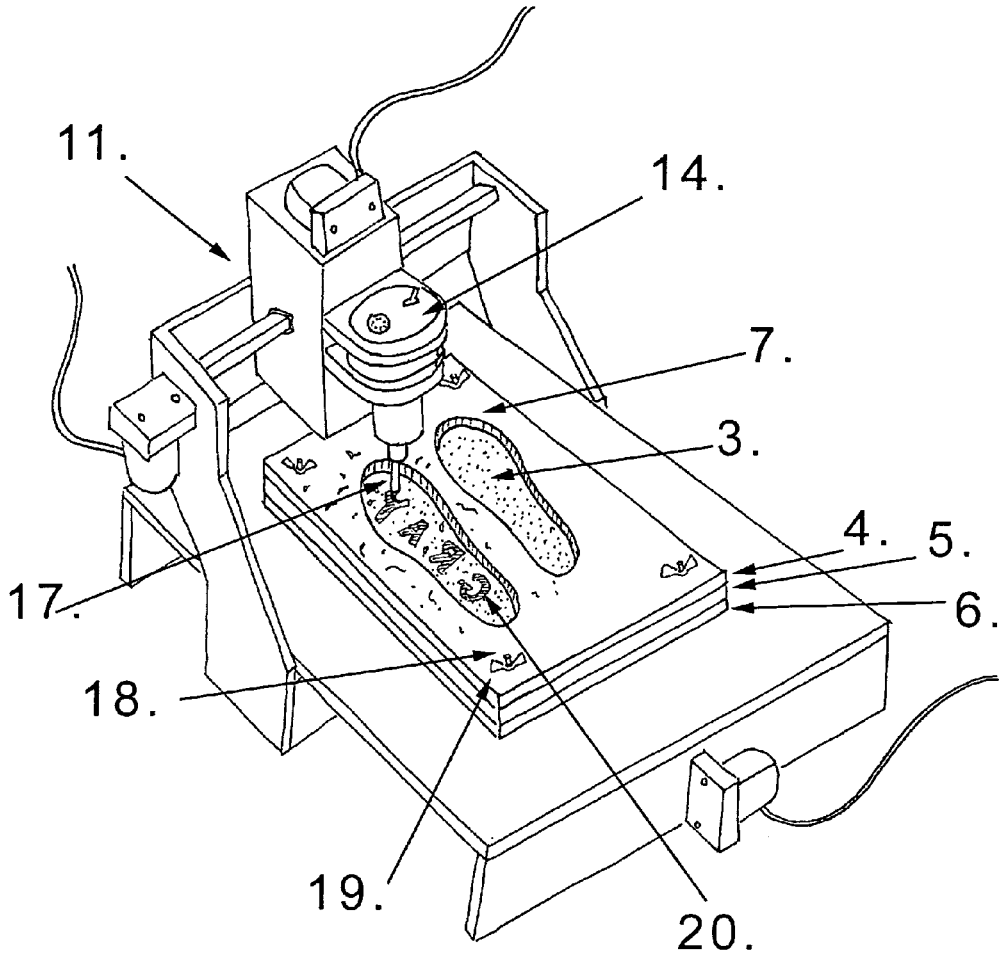
FIG. 7 illustrates a CNC machine in operation as it routes a design into the soles of a pair of footwear that has been fixed firmly in place with the use of bolted plates in accordance with aspects of the subject matter disclosed herein.

FIG. 2 illustrates a top view of a series of boards that hold the footwear firmly in place when stacked and mounted to the CNC machine table illustrated in FIGS. 4 and 7. FIG. 2 illustrates a series of three boards or plates that hold the footwear, although it will be appreciated that more than three plates can be used. Alternatively, two plates can be used if the interior and bottom plates are combined into one plate as described above. Each of the plates can include a negative cavity cut into it for a left shoe or a right shoe or can include both a negative cavity for the left shoe and a negative cavity for the right shoe or can include cavities for multiple pairs of shoes. The negative cavity can be cut partially or entirely through the entire thickness of the plate. Each plate can be constructed of a material including but not limited to wood, plastic, or metal. The negative space, in each plate in the series of plates, can be cut to accommodate the shape of the footwear that each set of plates is meant to hold. A set of a series of plates can be prepared for each size of footwear into which a design is cut.

In FIG. 2, the middle plate 5 has a negative space 8 cut into the middle plate 5. The middle plate 5 can be a receiving plate that receives the shoe. That is, the negative space 8 in middle plate 5 can be slightly larger than the footwear so that the footwear can be fitted into the negative space 8. The thickness of the middle plate 5 can be approximately the same thickness as the sole of the footwear placed into the plate so that when the plates are stacked, with the footwear contained within the series of plates, the footwear is held snugly and firmly and does not have room to move.

In FIG. 2, the top plate of the series of plates is represented by top plate 4 and the bottom plate of the series of plates is represented by bottom plate 6. Top plate 4 and bottom plate 6 can have the same negative shape cut into them. Top plate 4 and bottom plate 6 may be interchangeable so that top plate 4 can be used as bottom plate 6 or vice versa. Alternatively, top plate 4 and bottom plate 6 may not be interchangeable. The negative space 7 in the top plate 4, and the negative space 9 in the bottom plate 6 have shapes that can be cut to be slightly smaller than the negative space 8 in the middle plate 5. Unlike the middle plate 5, the top plate 4 and bottom plate 6 may not be the same thickness as the footwear. Top plate 4 and bottom plate 6 can be as thick as necessary to firmly hold the footwear in place, to allow room for any straps 2 or other upper the footwear may have, while keeping the machineable sole surface 3 flat and level.

Figure 3:
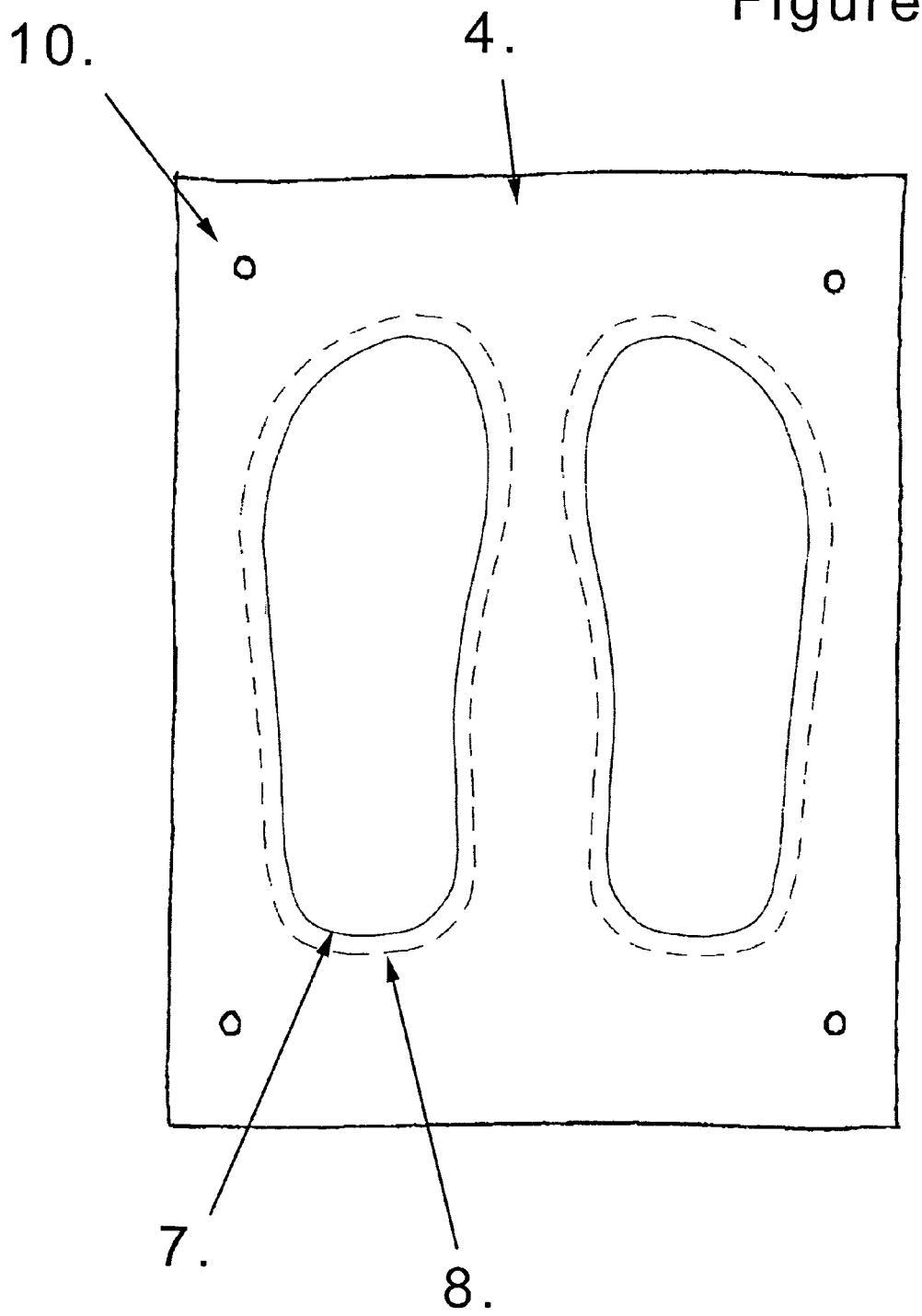
FIG. 3 illustrates an example of a difference in size between the negative cavities of the smaller top and bottom plates, and the middle plate in accordance with aspects of the subject matter disclosed herein.

FIG. 3 illustrates an example of a bottom view of the top plate 4 as it would appear when stacked overtop of the middle plate 5. In FIG. 3 the contour of the negative space 8 in the middle plate 5 of FIG. 2 is shown as a dashed line while the contour of the negative space 7 for the top plate 4 of FIG. 2 is shown as a solid line in FIG. 3. Because the top plate 4 and the bottom plate 6 have negative spaces that are slightly smaller than the outline of the footwear (e.g., flip flop 1), the footwear is held firmly in place by the top plate 4 and bottom plate 6 when the three plates are stacked. The middle plate 5 prevents the footwear from moving sideways while the top plate 4 and bottom plate 6 sandwich the edges of the footwear and prevent it from moving up or down during the machining process.

Because the footwear can be inserted into the middle plate 5 upside down, the negative spaces 9, as illustrated in FIG. 2 in the bottom plate 6 allow for the footwear upper (e.g., thong style straps 2) to hang down into the negative space 9 and not interfere with the machining process or cause the flat machineable footwear sole 3 to become uneven as would happen if the upper were simply to be sandwiched directly against the router table surface 13.

The negative spaces 7 in the top plate 4 leave the upward facing bottom soles 3 exposed for the CNC machine, illustrated in FIG. 4, e.g., CNC machine 11, to cut them. FIG. 4 illustrates an example of a CNC routing machine 11 and its parts. CNC routing machines such as CNC routing machine 11 are commercially available for machining plastics, metals, wood and so on. A machine such as CNC routing machine 11 can be purchased from Zenbot CNC or other CNC machine manufacturer. CNC machine 11 can allow for a router 14 to be mounted in carriage 21 in a vertical position. Router 14 can be filled with a routing bit 17 such as but not limited to an end mill routing bit, round nose bit, roundover, and custom-designed bits. The carriage 21 can be capable of moving along the Z-axis allowing the router 14 to cut at various depths. The carriage 21 can be attached to a crossbeam 16 that allows the router tool 14 and carriage 21 to move along an X-axis. The crossbeam 16 can be further attached to a gantry 15 that allows for movement along the Y-axis. The table 13 resting on base 12 can receive four threaded bolts 18 that fit through the aligned corner holes 10 on each of the three plates. When properly programmed with CNC machining software, mounted router tool 14 can be used to cut various designs and shapes into many materials in addition to being used for many other applications.

Figure 5:
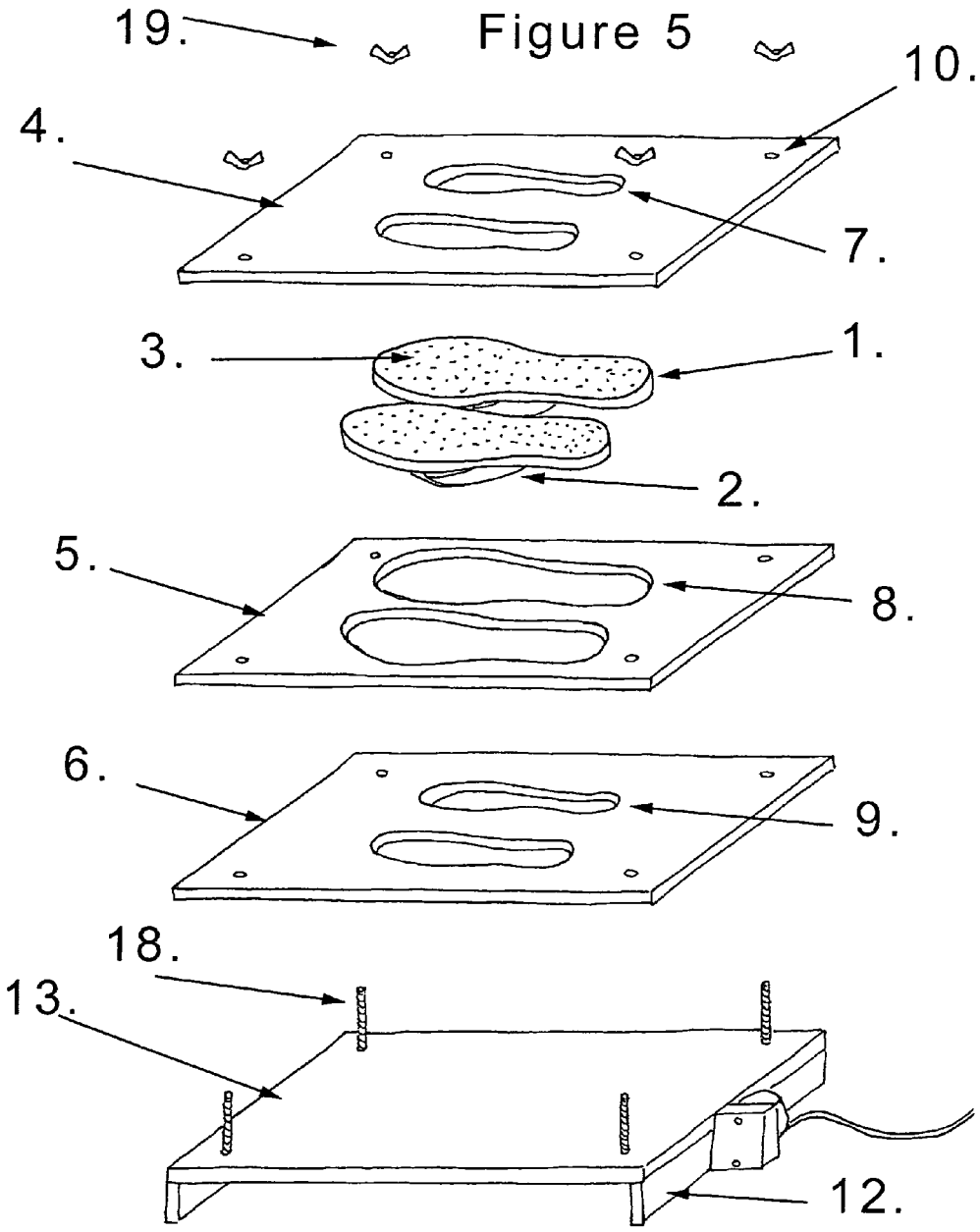
FIG. 5 illustrates the three plates and the footwear in the order that they would be fitted and bolted onto the router table in accordance with aspects of the subject matter disclosed herein.

FIG. 5 illustrates a sequence in which a series of three plates and the footwear can be attached to the table 13 and base 12 of the CNC machine 11 of FIG. 4. FIG. 5 depicts part of the CNC machine 11 as necessary for illustration. As shown in FIG. 4, the table 13 has four threaded bolts 18 that fit through the aligned corner holes 10 on each of the three plates. The bottom plate 6 can be first fitted onto the bolts 18 and the table 13. Then the middle plate 5 can be similarly positioned on top of the bottom plate 6. The footwear that is to be cut can then be fitted into the negative space 8 of the middle plate 5. The upper of the footwear can be allowed to hang down into the negative space 9 of the bottom plate 6. The top plate 4 can then be put into place over top of the middle plate 5. Wing nuts 19, or other appropriate nuts, can then be threaded onto the four threaded rods 18 and can be used to securely fasten the three plates into place on the router table 13. Alternatively, clamps or any other fastening hardware or method can be used to hold the plates together. FIG. 7 depicts the stack of plates, and the footwear that it holds, firmly secured to the router table.

Figure 6:
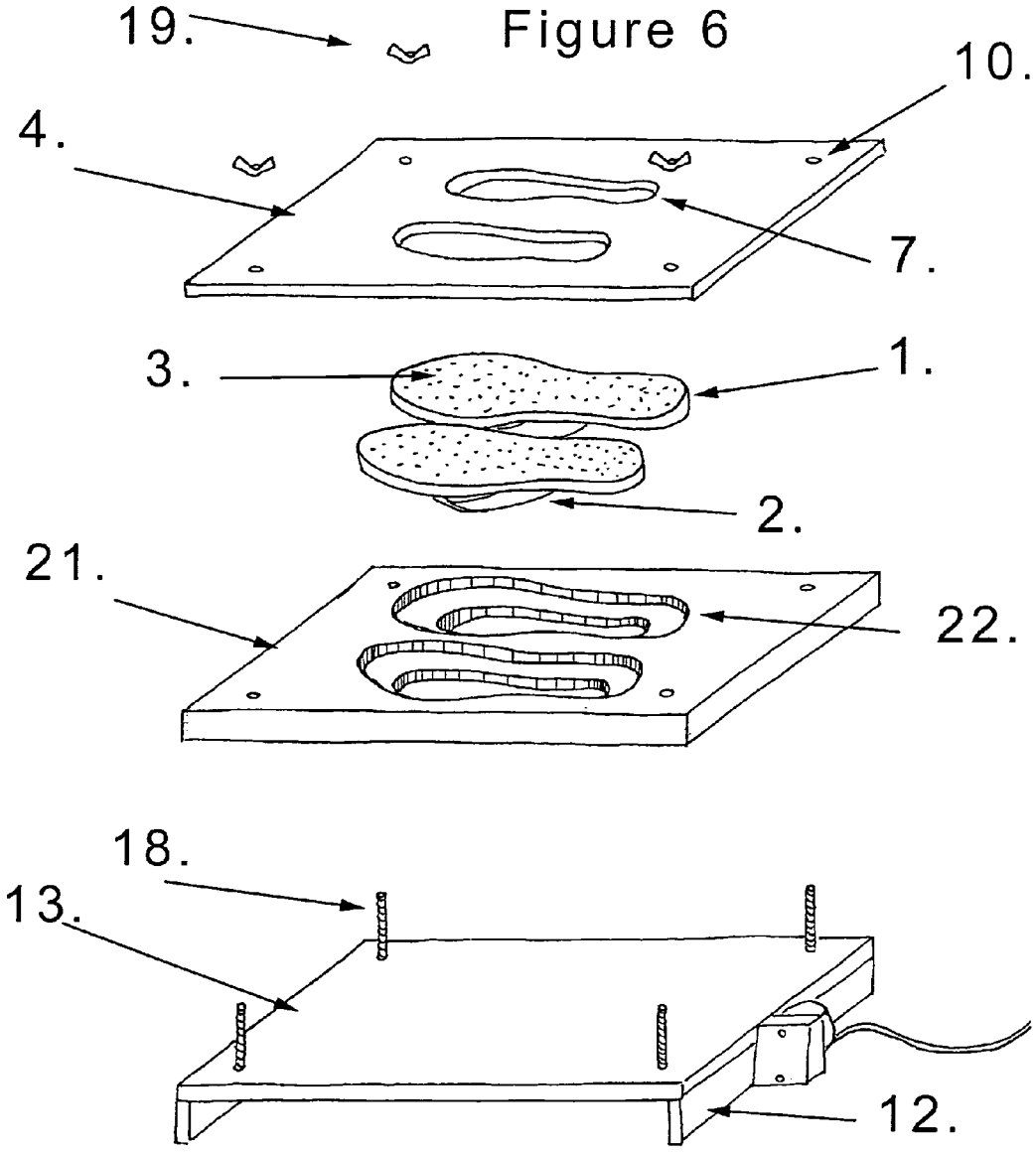
FIG. 6 illustrates an alternative bottom plate that contains that same negative cavity that is created by the combined middle and bottom plates in FIG. 5 and, can be substituted for these two plates and bolted onto the router table in accordance with aspects of the subject matter disclosed herein.

FIG. 6 illustrates an alternative version of FIG. 5 in which a sequence of two plates and footwear can be attached to the table 13 and base 12 of the CNC machine 11 of FIG. 4. FIG. 6 shows how the alternative bottom plate 21 can also be made to perform the functions that the middle plate 5 and the bottom plate 6 serve in FIG. 5. The alternative bottom plate 21 does this by including a negative cavity 22 that both fits the outline of the footwear, holds it snugly in place so that it does not move up, down, or sideways while being machined, as well as allows for the footwear upper to hang down and not interfere with the machining of the footwear.

FIG. 7 illustrates the CNC machine 11 and the mounted routing tool 14 in operation as they cut a design into the bottom soles 3 of a pair of flip flops 1 or other flat soled footwear. Because the stacked plates have negative spaces fitted to hold the footwear firmly in place while exposing a significant portion of the soles 3 as a flat machineable surface, designs can easily be cut into the soles 3. These designs can be composed of or can include any desired combination of letters, numbers, symbols, lines, and images as specified by the customer. The design on the sole of one piece of footwear can be made to match the design on the sole of the other piece of footwear within a pair. Alternatively, each piece of footwear within a pair can include a different design. Designs can be cut into the sole so as to be legible when viewing the footwear soles. Alternatively, the designs can be cut in reverse (mirror image) so that the impression that they create in a material into which the shoe is pressed is mirrored and legible. CNC routing tool 14 can cut the design using an end mill routing bit 17, but other routing bits, such as round nose bits, roundover, and custom-designed bits can be used. The same design can be cut into each sole, or a first design can be cut into one sole and a second design can be cut into the second sole of a pair of footwear. As described above, a mirror image of a design can be cut into the sole so that the imprint left in a soft substrate after walking or otherwise moving while wearing the footwear is a positive image specified by a customer.

Figure 8:
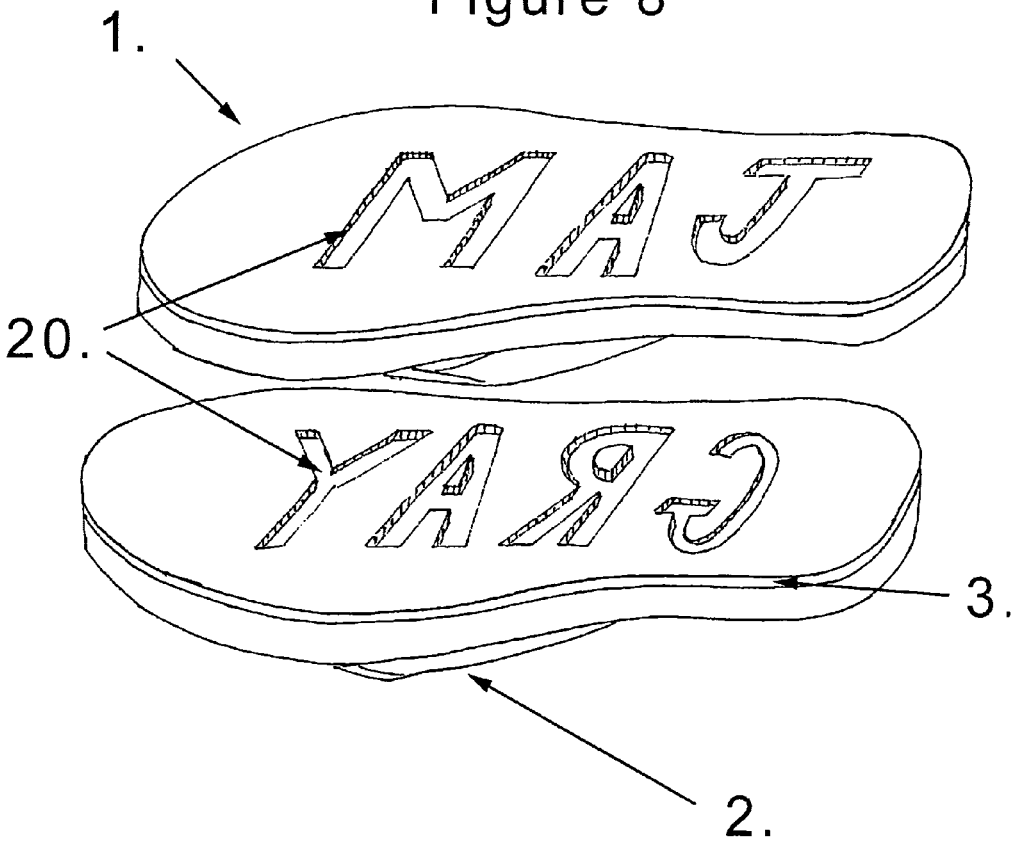
FIG. 8 illustrates a pair of footwear after a design has been successfully cut into its bottom soles in accordance with aspects of the subject matter disclosed herein.

FIG. 8 illustrates an example of the soles 3 of a finished pair of footwear after the machining process is complete and the footwear has been removed from the plates. The design 20 cut into the soles 3 can be cut at the same depth throughout the entirety of the design. The cuts produced by the process can be clean and consistent because the footwear was prevented from moving during the machining process.

What is claimed is:

1. A method of producing a single customized pair of footwear, the method comprising:

providing a series of plates comprising a receiving plate comprising a negative cavity shaped to receive a shoe and prevent the shoe from moving during cutting and wherein a thickness of the receiving plate is approximately a thickness of a sole of the shoe;

securing the shoe comprising an upper and a sole, using the series of plates positioned on a computer numerical control machine table; and cutting a specified design into a bottom surface of the sole of the shoe using a computer numerical control machine.

2. The method of claim 1, wherein the securing the shoe further provides that the shoe comprises a flip flop, sandal, or boot.

3. The method of claim 1, wherein the providing further provides that the negative cavity of at least one top plate of the series of plates is smaller than the negative cavity of the receiving plate and wherein the at least one top plate secures the shoe by overlapping edges of the shoe.

4. The method of claim 1, wherein the providing further provides that the negative cavity of at least one bottom plate of the series of plates is smaller than the negative cavity of the receiving plate and wherein the at least one bottom plate secures the shoe by overlapping edges of the shoe.

5. The method of claim 4, wherein the securing the shoe further provides that the upper of the shoe is suspended within the negative cavity of the at least one bottom plate, and does not obstruct cutting by the computer numerical control machine.

6. The method of claim 1, wherein the cutting the specified design further provides that the bottom surface of the sole of the shoe is flat and wherein at least a portion of the bottom surface is exposed for cutting by the computer numerical control machine by the series of plates.

7. The method of claim 1, wherein the cutting the specified design further provides that the specified design cut into the bottom surface of the sole is cut in reverse, so that a positive image appears when the shoe is pressed into material capable of taking an impression.

8. The method of claim 1, wherein the cutting the specified design further provides that the specified design cut into the bottom surface of the sole of a first shoe of the pair of footwear differs from the specified design cut into the bottom surface of a second shoe of the customized pair of footwear.

9. The method of claim 1, wherein the providing further provides that the series of plates comprises at least one top plate, a middle plate comprising the receiving plate and at least one bottom plate.

10. A method of producing a single customized pair of footwear, the method comprising:

providing a series of plates comprising at least two plates, comprising a plate with a negative cavity shaped to receive the footwear, wherein a negative cavity of a bottom plate receives the footwear and prevents the footwear from moving by having a first larger negative cavity for receiving the footwear sole, and an additional, connected, and second smaller negative cavity, immediately below the first larger negative cavity, the second smaller negative cavity configured to receive the upper of the footwear;

securing a shoe comprising an upper and a sole, using the series of plates positioned on a computer numerical control machine table; and cutting a specified design into a bottom surface of the sole of the shoe using a computer numerical control machine.

11. The method of claim 10, wherein the providing further provides that the negative cavity of at least one top plate of the series of the at least two plates is smaller than the first large negative cavity of the bottom plate and wherein the at least one top plate secures the footwear by overlapping edges of the footwear.

12. The method of claim 1, wherein the cutting the specified design further provides that the specified design is cut into the bottom surface of the sole after the shoe is completely assembled.

13. The method of claim 1, wherein the cutting the specified design further provides that the specified design is specified by a customer and comprises at least one image or character.

14. A method of producing customized footwear, the method comprising:

providing a series of plates comprising negative cavities configured to hold a pair of shoes;

securing a shoes comprising upper and a sole, using the series of plates positioned on a computer numerical control machine table; and cutting a specified designing into a bottom surface of the sole of the shoe using a computer numerical control machine.

15. The method of claim 1, wherein the cutting further provides that the sole is flat during the cutting by the computer numerical control machine.

* * * * *